US010334705B2

(12) United States Patent
Meerbeek et al.

(10) Patent No.: US 10,334,705 B2
(45) Date of Patent: Jun. 25, 2019

(54) USER DETERMINABLE CONFIGURATION OF LIGHTING DEVICES FOR SELECTING A LIGHT SCENE

(71) Applicant: SIGNIFY HOLDING B.V., Eindhoven (NL)

(72) Inventors: Berent Willem Meerbeek, Veldhoven (NL); Bartel Marinus Van De Sluis, Eindhoven (NL); Huon Urbald Ogier Norbert Van De Laarschot, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/777,321

(22) PCT Filed: Nov. 7, 2016

(86) PCT No.: PCT/EP2016/076819
§ 371 (c)(1),
(2) Date: May 18, 2018

(87) PCT Pub. No.: WO2017/084904
PCT Pub. Date: May 26, 2017

(65) Prior Publication Data

US 2018/0352635 A1 Dec. 6, 2018

(30) Foreign Application Priority Data

Nov. 19, 2015 (EP) ..... 15195429

(51) Int. Cl.
*H05B 37/02* (2006.01)

(52) U.S. Cl.
CPC ..... *H05B 37/0272* (2013.01); *H05B 37/029* (2013.01); *H05B 37/0227* (2013.01)

(58) Field of Classification Search
None
See application file for complete search history.

(56) References Cited

U.S. PATENT DOCUMENTS

2008/0258646 A1* 10/2008 Beij ..... H05B 37/0245 315/291
2010/0134019 A1 6/2010 Berhorst
2010/0181938 A1* 7/2010 Boleko Ribas .... H05B 37/0245 315/312

(Continued)

FOREIGN PATENT DOCUMENTS

EP 1870802 A1 12/2007
EP 2763508 A2 * 8/2014 ..... H05B 37/0272
WO 2010010493 A2 1/2010

(Continued)

*Primary Examiner* — Dedei K Hammond
(74) *Attorney, Agent, or Firm* — Meenakshy Chakravorty

(57) ABSTRACT

A user can control a plurality of lighting devices by positioning them in a configuration (e.g. a circular configuration). Through receiving the positions of the lighting devices a shape of the configuration can be determined. From a set of light scenes, each light scene associated with a shape, a light scene can be selected matching the shape of the configuration. The plurality of lighting devices are then controlled based on the selected light scene. This allows a user to select, for example, a romantic light scene by placing the lighting devices in a heart shape symbol.

15 Claims, 6 Drawing Sheets

(56) References Cited

U.S. PATENT DOCUMENTS

| | | | |
|---|---|---|---|
| 2012/0286673 | A1 | 11/2012 | Holland et al. |
| 2014/0085108 | A1 | 3/2014 | Clifford et al. |

FOREIGN PATENT DOCUMENTS

| | | | |
|---|---|---|---|
| WO | 2011073881 | A1 | 6/2011 |
| WO | 2014009422 | A1 | 1/2014 |
| WO | 2014120933 | A1 | 8/2014 |

* cited by examiner

USER DETERMINABLE CONFIGURATION OF LIGHTING DEVICES FOR SELECTING A LIGHT SCENE

CROSS-REFERENCE TO PRIOR APPLICATIONS

This application is the U.S. National Phase application under 35 U.S.C. § 371 of International Application No. PCT/EP2016/076819, filed on Nov. 7, 2016, which claims the benefit of European Patent Application No. 15195429.4, filed on Nov. 19, 2015. These applications are hereby incorporated by reference herein.

FIELD OF THE INVENTION

The invention generally relates to lighting devices, and more specifically to portable, wirelessly controllable lighting devices. The invention further relates to a method for controlling such a lighting device and to a computer program product for performing the method.

BACKGROUND OF THE INVENTION

Modern lighting devices offer advanced control features, such as color control and dim level control. Output of the lighting device can be controlled through the device itself (e.g. through a color wheel integrated in the lighting device) and for wirelessly controllable lighting devices the output can be controlled remotely (e.g. through an application on a smart phone). Such control options are currently used for lighting devices that are typically placed in a fixed position (e.g. a ceiling pendant) as well as lighting devices that a user repositions frequently (e.g. a battery operated, portable lighting device).

SUMMARY OF THE INVENTION

The inventors have realized that more intuitive control options can be realized for lighting devices that a user repositions. An example of a lighting device that a user can easily reposition is the Philips Hue Go, a battery operated, portable lighting device which can be remotely controlled to provide light of various colors and at various dim levels. Such a lighting device can, as an illustrative example, be positioned by a user on the patio for providing mood lighting during pre-dinner drinks. The same device can then, later that evening, be placed next to a couch for providing functional white light to support the user enjoying some late-night reading. When a plurality of lighting devices, such as multiple of the aforementioned battery operated, portable lighting device, are placed in a user determinable configuration, the shape of the configuration can be used to select a light scene. For example, a user configuring a plurality of lighting devices in a heart symbol can thereby select a romantic light scene.

In a first aspect, a method of controlling a plurality of lighting devices in a user determinable configuration is provided. The method comprises: receiving positional data comprising the positions of multiple of the plurality of lighting devices in the user determinable configuration; determining, based on the received positional data, a shape of the configuration of the plurality of lighting devices; receiving a set of light scenes and an association of each light scene of the set of light scenes to a shape; selecting a light scene from the set of light scenes by matching the determined shape to the shape associated with the light scene; and controlling the plurality of lighting devices based on the selected light scene. The positional data received can comprise data based on which the absolute positions of lighting devices (e.g. GPS coordinates) or relative positions of lighting devices (e.g. x,y coordinates in a grid) can be determined. This data is used to determine the shape of the configuration of the plurality of lighting devices, for example by comparing the shape to default shapes and by subsequently determining which shape most closely matches the shape of the user determinable configuration.

A set of light scenes is received, for example retrieved from a local memory or from a remote storage, or from an online service. Each light scene of the set of light scenes is associated with a shape. A light scene can be associated with a single shape or a light scene can be associated with multiple shapes (e.g. a romantic light scene can be associated both with a heart symbol shape and with a cupid figure shape). By matching the shape of the user determine configuration of the lighting devices to one of the shapes associated with the light scenes in the set of light scenes, the proper light scene can be selected according to which the plurality of lighting devices is controlled.

Thus a method is provided which allows a user to configure a plurality of lighting devices such that the shape according to which the user has configured the plurality of lighting devices determines a light scene to be selected according to which the plurality of lighting devices are controlled. This allows intuitive control of a light scene, for example, using battery operated, portable lighting devices which can easily be configured according to a shape.

In an embodiment of the method according to the first aspect, determining the shape of the configuration of the plurality of lighting devices is further based on a light pattern shape which the plurality of lighting devices are capable of producing. By determining the shape of the light effect produced by (at least a part of) the plurality of lighting devices, differences can be accounted for between the shape of the configuration of the plurality of lighting devices (e.g. circular) and the shape of the light effect of the configuration of the plurality of lighting devices (e.g. water drop shape). The light effect produced by one lighting device of the plurality of lighting devices need not be the same as the light effect produced by another lighting device of the plurality of lighting devices, for example, due to their optical properties or their position (e.g. distance) in view of a surface towards which they emit light.

In yet a further embodiment of the method according to the first aspect, the positional data comprises the relative position of one or more of the plurality towards one or more objects. The one or more objects can be a further one or more of the plurality of lighting devices. It can be beneficial to determine the shape of the configuration of the plurality of lighting devices based on their relative position as such positional data can easily be determined, e.g. when each lighting device has a radio for sending and receiving data and further allowing signal strength measurements to be performed.

In various embodiments of the method according to the first aspect, the method further comprises determining a size of the determined shape, and controlling the plurality of lighting devices is further based on said size; and/or determining the number of lighting devices that are comprised in the plurality of lighting devices, and controlling the plurality of lighting devices is further based on said number; and/or determining the distance between at least one a further one of the plurality of lighting devices, and controlling the plurality of lighting devices is further based on said distance;

and/or determining an orientation of at least one of the plurality of lighting devices (e.g. up/down, direction of the light emission window, etc.), and controlling the plurality of lighting devices is further based on said orientation. The orientation of the at least one of the plurality of lighting devices can be an orientation relative to the environment of the configuration of the plurality of lighting devices (e.g. the orientation of the plurality of lighting devices in relation to a wall to which they are mounted). The orientation of the at least one of the plurality of lighting devices can be relative to a further at least one of the plurality of lighting devices (e.g. a first lighting device being positioned on top of a second lighting device amongst the plurality of lighting devices).

In an embodiment of the method according to the first aspect, one or more further lighting devices (i.e. lighting devices that are not part of the plurality of lighting devices, in other words, not part of the shape the user has configured the lighting devices in) are controlled based on the selected light scene. This is beneficial as a user configuring the plurality of lighting devices in a heart symbol shape may want further lighting devices to be a part of the romantic light scene that is thus selected.

In a second aspect, a computer program product is provided for performing the method according to the first aspect. The computer program product is arranged for performing the method when run on a computer device. Such a computer device can, for example, be a chip embedded in a lighting controller or a lighting device. As a further example, the computer program product can be an application that is downloaded onto a smart phone or similar device which can then receive positional data comprising the positions of multiple of the plurality of lighting devices in the user determinable configuration, and determine, based on the received positional data, a shape of the configuration of the plurality of lighting devices, and further receive a set of light scenes and an association of each light scene of the set of light scenes to a shape, and then select a light scene from the set of light scenes by matching the determined shape to the shape associated with the light scene, in order to control the plurality of lighting devices.

In a third aspect, a controller for controlling a plurality of lighting devices in a user determinable configuration is provided. The controller comprises a first interface, a second interface and a processor. The first interface is arranged for receiving positional data comprising the positions of multiple of the plurality of lighting devices in the user determinable configuration. The second interface is arranged for receiving a set of light scenes and an association of each light scene of the set of light scenes to a shape. The processor is arranged for determining a shape configuration of the plurality of lighting devices. The processor is further arranged for selecting a light scene from the set of light scenes by matching the determined shape to the shape associated with the light scene. The processor is still further arranged for controlling the plurality of lighting devices based on the selected light scene.

In an especially advantageous embodiment, the controller is further arranged to operate as a lighting device comprised in the plurality of lighting devices; in other words: the controller is embedded in a lighting device. As such, one of the lighting devices of the plurality of lighting devices can comprise the controller functionality. Such functionality can, in yet another embodiment, be distributed over multiple lighting devices or even all lighting devices of the plurality of lighting devices.

In a fourth aspect, a system is provided. The system comprises the controller according to the third aspect and a plurality of lighting devices. Providing such a system is beneficial as the controller and the plurality of lighting devices can be, for example, pre-configured to operate as a system.

These and other aspects of the invention will be apparent from and elucidated with reference to the embodiments described hereinafter.

DETAILED DESCRIPTION OF EMBODIMENTS

Figure 1:
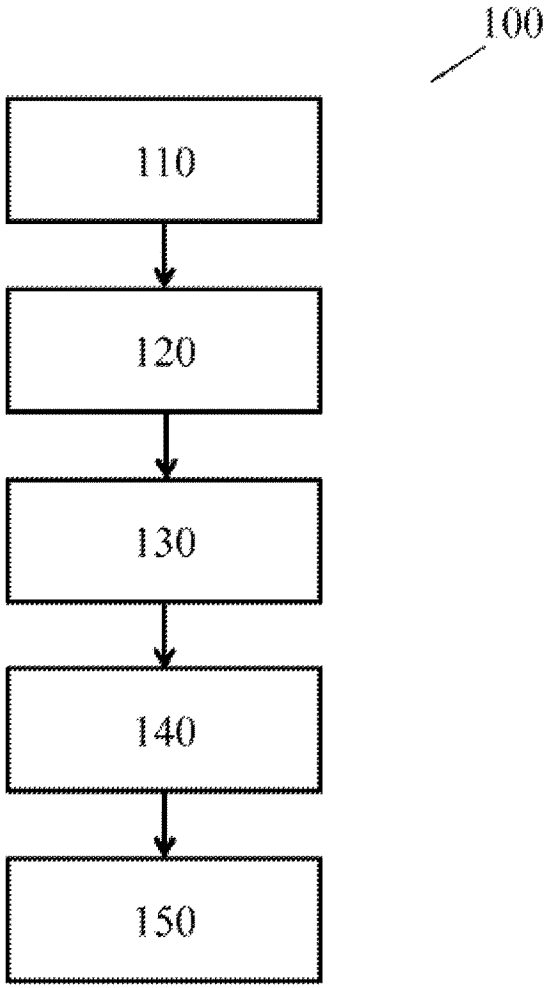
FIG. 1 shows schematically and exemplarily a method of controlling a plurality of lighting devices in a user determinable configuration.

In FIG. 1 a method 100 of controlling a plurality of lighting devices in a user determinable configuration is shown. The method comprises: receiving positional data 110 of multiple of a plurality of lighting devices, determining a shape 120, receiving light scenes 130, selecting a light scene 140, and controlling 150 the plurality of lighting devices. The lighting devices are in a user determinable configuration, as such the user has placed one or more of the lighting devices with some degree of freedom in their respective positions. All of the lighting devices can be placed freely or one or more of the lighting devices can be in a fixed position (e.g. the lighting devices may need to be positioned on a surface; one of the lighting devices is in a fixed position and the remaining lighting devices of the plurality of lighting devices need to be placed within a predetermined distance of the fixed lighting device; or all lighting devices must be placed within a predetermined distance of each other).

The positional data received comprises the positions of multiple of the plurality of lighting devices in the user determinable configuration. Preferably the position of each of the plurality of lighting devices is known, yet this may not be necessary. As an example, if ten lighting devices are together arranged in a circle such can be determined with a sufficient degree of certainty when the position of multiple of the lighting devices is known. This certainty increases as the position of more lighting devices of the plurality of lighting devices is known. The positional data that is received can comprise absolute positions of lighting devices, for example when each of the lighting devices of the plurality of lighting devices has a GPS sensor and determines its own absolute position. The positional data that is received can comprise relative positions of lighting devices, for example when each of the lighting devices acts as a receiver and transmitter and uses signal strength calculations to determine their position. The received positional data is used for determining a shape of the configuration of the plurality of lighting devices. For example, from the positional data it can be deduced that the plurality of lighting devices are arranged to spell out a word (e.g. love), or to provide a symbol (e.g. a heart shape). A shape is the form of the configuration of the plurality of lighting devices. It can, but need not, further relate to the size of the configuration, the density of lighting devices within or along the outline of the configuration, etc.

From an external data base, a cloud service or an internal memory, to name a few examples, a set of light scenes is received. Each light scene of the set of light scenes is associated with a shape. For example a romantic light scene may be associated with the shape of a heart symbol and may further be related to the shape of the word 'love' spelled out. A light scene is selected from the set of light scenes by matching the determined shape to the shape associated with the light scene. Although matching can, for example, relate to finding an exact match (hard match), matching can also, as a further example, relate to finding a congruent shape, a similar shape or a homeomorphic shape (soft match). The latter can compensate for, as yet another example, a user having made a less than perfect circle with the plurality of lighting devices.

The plurality of lighting devices are then controlled based on the selected light scene. This allows a user to position a plurality of lighting devices in a heart shape and these lighting devices to provide light output according to a 'romantic light scene' associated with the heart shape. As a further example, a shape can be repetitive, such as a user configuring the plurality of lighting devices as multiple heart shape symbols. The use of the phrase 'shape' can thus also relate to a 'pattern'. As yet a further example, a user can configure the plurality of lighting devices in a row, the shape of the configuration of lighting devices is then a (straight) line. Further, when a user configures the plurality of lighting devices such that the lighting devices are in a (straight) line they can be positioned close to each other (e.g. each lighting devices less than 10 cm apart from the next) or far away from each other (e.g. each lighting device more than 10 cm apart from the next) to select a functional light scene. This allows a user, continuing the example, to select respectively a cozy light scene, e.g. with narrow beams, or a functional light scene, e.g. with broad beams.

Optionally, one or more further lighting devices (e.g. a nearby chandelier) can be controlled based on the selected 'romantic light scene'. When the plurality of lighting devices in the shape of a heart symbol is rearranged, for example to form a circle, certain of the lighting devices may not be used or additional lighting devices may have to be added by the user, to configure the circle. Lighting devices not used in the circle, in this example, need not be controlled (or, for example, are controlled to be turned off) and lighting devices added to the configuration are controlled as part of the plurality of lighting devices making up the new configuration of a circle.

Figure 2:
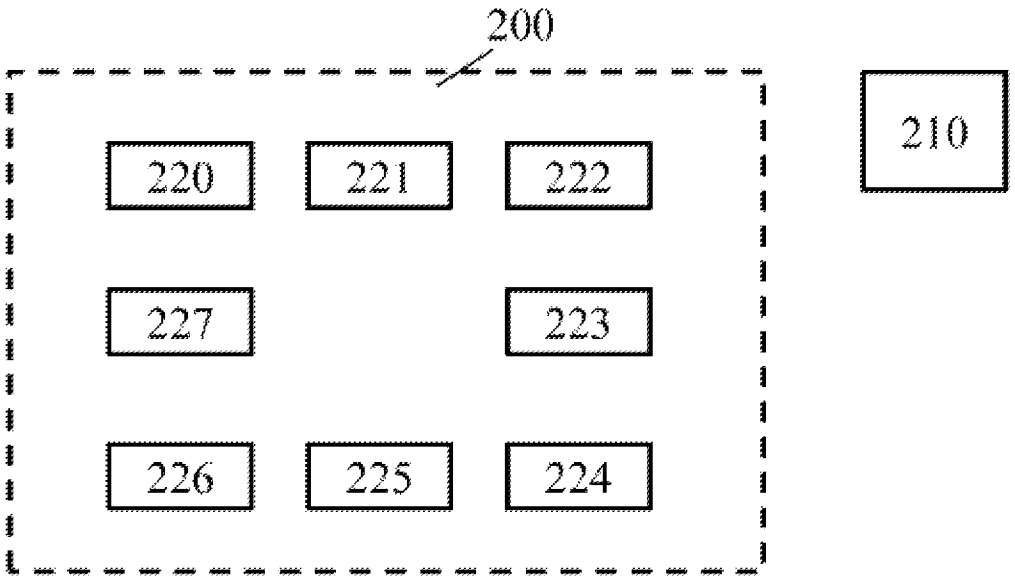
FIG. 2 shows schematically and exemplarily a controller and a plurality of lighting devices.

FIG. 2 shows a plurality of lighting devices 200 and a controller 210. The controller 210 determines in what shape the lighting devices 220, 221, 222, 223, 224, 225, 226 and 227 are configured (e.g. a square, circular or rectangular configuration). The controller receives positional data related to at least some of the plurality of lighting devices 200. The positional data can comprise, for example, a video feed or a still image from a camera or positional data on individual lighting devices extracted from such a video feed or still image. As another example, the positional data can comprise the absolute position of the lighting devices as determined by a GPS receiver in the lighting devices. It is not necessary that the position of each lighting device is determined. The shape of the configuration of the plurality of lighting devices can be determined with a sufficient degree of certainty when the position of at least some of the lighting devices is known. In FIG. 2 for example, if there are light scenes related to a circular shape and to a straight line shape, then receiving the position of lighting devices 220, 221, 222, 223 and 224 but not of lighting devices 225, 226 and 227 would be sufficient to match the shape of the user determined configuration to the correct light scene.

Figure 4:
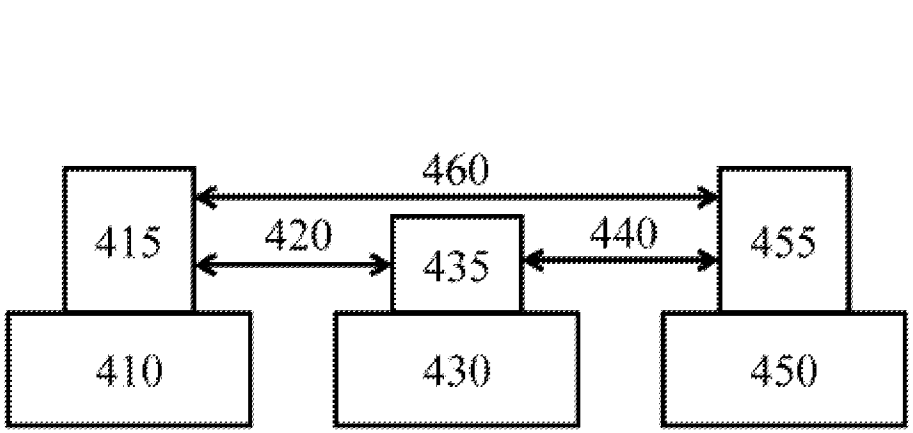
FIG. 4 shows schematically and exemplarily a plurality of lighting devices determining their relative position towards each other.
Figure 3:
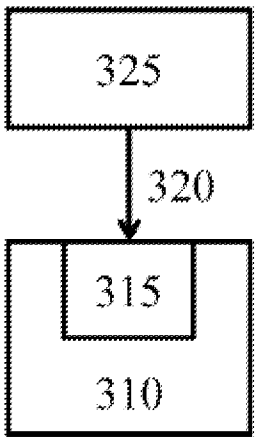
FIG. 3 shows schematically and exemplarily a lighting device arranged for determining its position.
Figure 5:
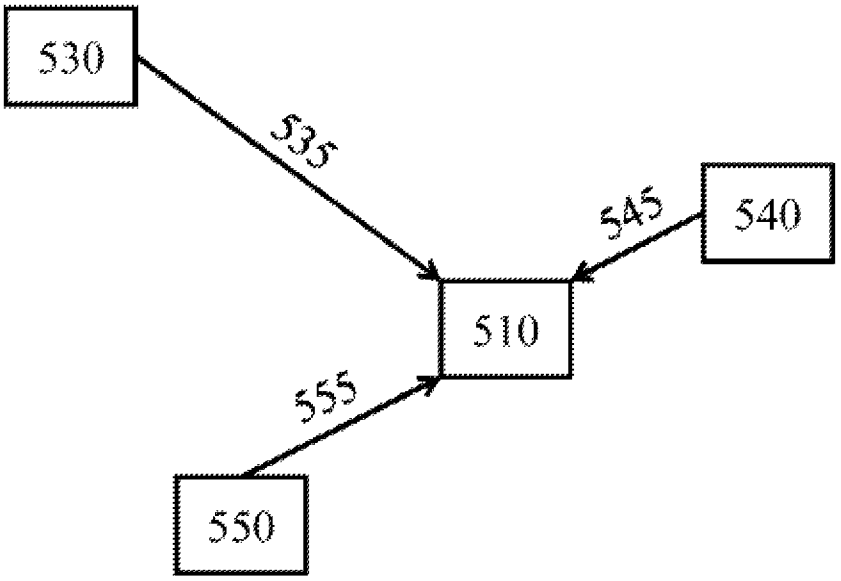
FIG. 5 shows schematically and exemplarily a lighting device triangulating its position.

FIG. 3 illustrates a lighting device 310 comprising a GPS receiver 315 receiving a GPS signal 320 from a GPS satellite. This positional data can, for example, be passed on to a controller, separately or jointly with positional data of other lighting devices. This is merely one example of determining a position of a lighting device. Other options include a lighting device having a light sensor to receive a coded light signal as part of an indoor positioning system. In FIG. 4 a first lighting device 410 with a first send/receive unit 415, a second lighting device 130 with a second send/receive unit 435 and a third lighting device 450 with a third send/receive unit 455 are shown. The first send/receive unit is in communication 420 with the second send/receive unit 435 and further in communication 460 with the third send/receive unit 455. The second send/receive unit is further in communication with the third send/receive unit 440. As all three lighting devices 410, 430 and 450 are able to send and receive a signal, e.g. a ZigBee or WiFi signal, they are able to determine their relative positions. Determining the position can be based on, for example, signal strength or time of flight of a signal. The relative position of a lighting device can be determined in in view of the other lighting devices, or in view of another object. For example, the lighting devices can determine their position in relation to one or more beacons of which they can receive a signal. In various embodiments, one or more of the lighting devices, the controller or additional devices configured to work as part of the system can determine the (relative) positions of the lighting devices. FIG. 5 shows a lighting device 510 determining its position based on receiving from a first device 530 a first signal 535, from a second device 540 a second signal 545 and from a third device 550 a third signal 555. The signals 535, 545 and 555 could be of the same type (e.g. WiFi signals) or of different types (e.g. a WiFi signal, a ZigBee signal and a further radio signal). The lighting device 510 comprises a receiver arranged to triangulate its position based on the received signals. The positional data received from the lighting device 510 and other lighting devices of the plurality of lighting devices can comprise raw data (e.g. signal strength measurements) or processed data (e.g. a lighting device knowing the position of each of the first device 530, second device 540 and third device 550 is able to determine its position based on the received signals and the positions of said devices). As a further example, the lighting device 510 can emit a signal that is received by the three devices 530, 540 and 550. This signal can be processed such that the three devices together determine the position of the lighting device 510. As yet another example, the lighting device 510 can receive a signal from two devices 530 and 540 and send a signal to the other device 550. As yet a further example, a lighting device can comprise a camera and image analysis techniques can be used to determine the position of the lighting device based on an image it captures.

Figure 6:
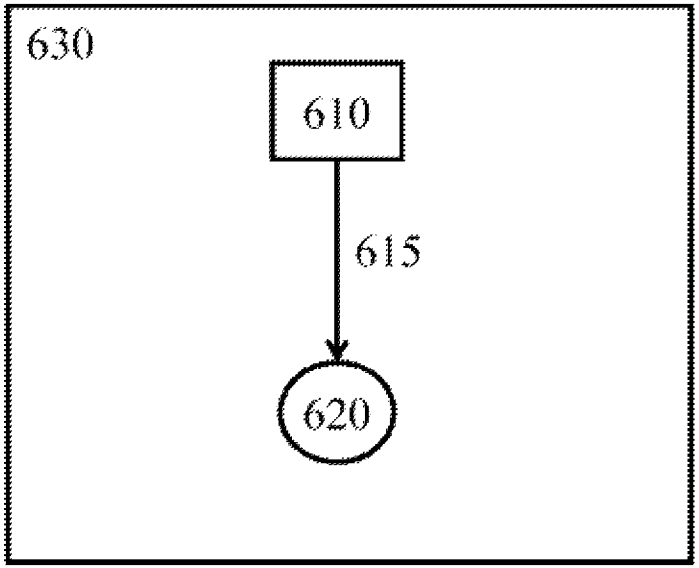
FIG. 6 shows schematically and exemplarily a lighting device rendering a lighting effect on a surface.

FIG. 6 shows a lighting device 610 (e.g. a table lamp placed on a table) emitting a beam of light 615 which creates a light effect 620 on a surface 630 (e.g. the table). The shape of the configuration of the plurality of lighting devices can further be determined based on a light pattern shape the plurality of lighting devices are capable of producing. For example, a plurality of lighting devices placed in a straight line can, based on their orientation towards a surface or based on their optics, generate a light effect other than a straight line. As a further example, a lighting device can have user configurable optics that allow a user to change the beam shape of the light emitted or change the direction of the beam. The positional data received relating to at least some of the plurality of lighting devices can comprise positional data on the light effect these lighting devices can produce. As an example, a lighting device can provide a position of where it will produce a light effect. As a further example, a lighting device can provide its own position and an offset to indicate where it will produce a light effect.

Figure 7:
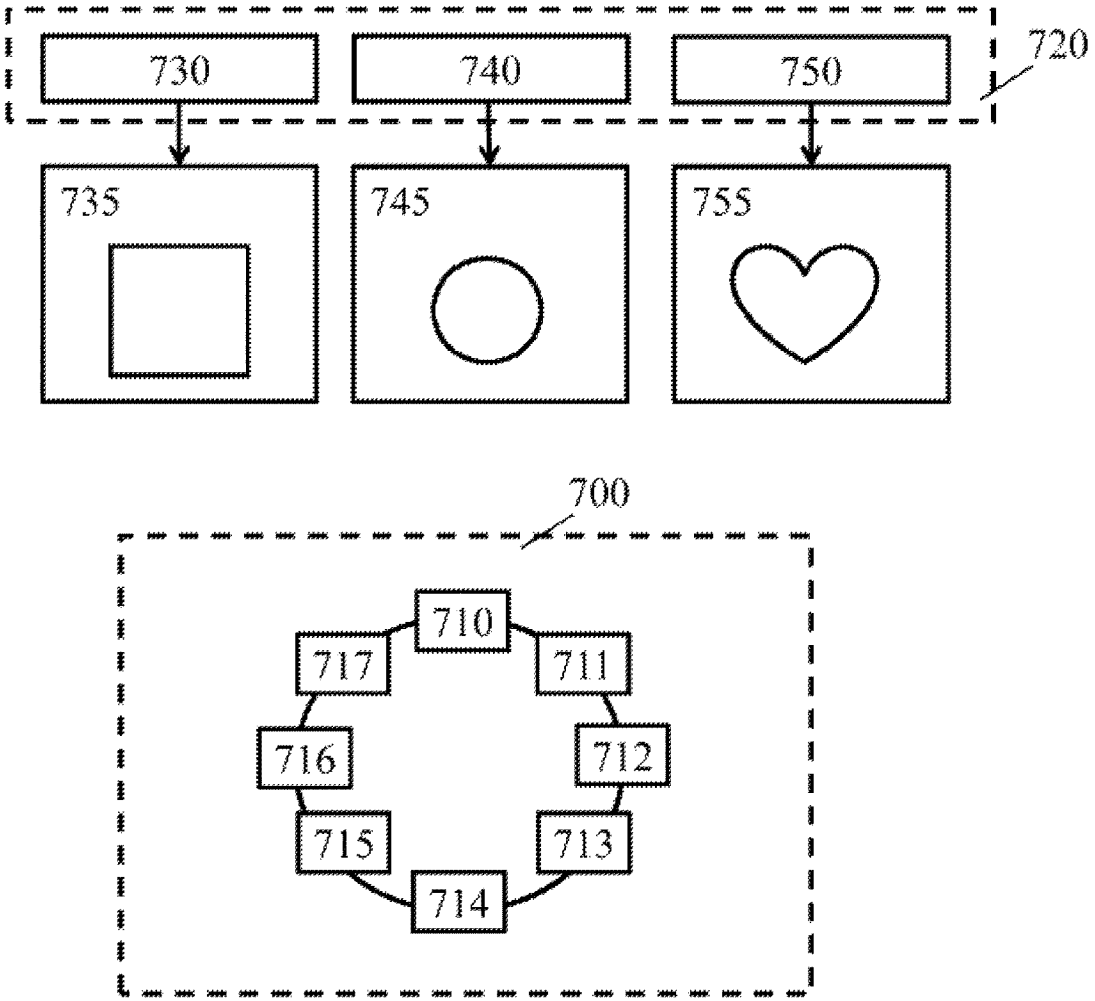
FIG. 7 shows schematically and exemplarily a plurality of lighting devices configured in a circle.

FIG. 7 shows a plurality of lighting devices 700 comprising lighting device 710, lighting device 711, lighting device 712, lighting device 713, lighting device 714, lighting device 715, lighting device 716 and lighting device 717. In this example, the lighting devices are arranged as a circle. A set of light scenes 720 comprises a first light scene 730 associated with a first shape 735 (e.g. a square), a second light scene 740 associated with a second shape 745 (e.g. a circle) and a third light scene 750 associated with a third shape 755 (e.g. a heart symbol). The method, or a device executing the method such as a controller, can determine that the shape of the user determinable configuration of the plurality of lighting devices 700 is a circle and that this matches the second shape 740 which is associated with the second light scene 740. The plurality of lighting devices 700 will then be controlled according to the second light scene 740.

As a further example, when the plurality of lighting devices is arranged in a circle the lighting devices can be controlled to show a rainbow effect moving around the circle. When there are twelve lighting devices making up the plurality of lighting devices, the lighting devices can be controlled to display a time indication (e.g. show where the hour and/or minute and/or second dial would cross the circle using separate colors). The orientation of the lighting devices can be used to determine what the top of the 'clock' is.

As yet another example, the lighting devices can be configured by a user in a straight line along a wall. When the light emission windows of the lighting devices are facing downward they will be controlled to provide soft wayfinding light (e.g. to assist a user in traversing the hallway at night), and when the lighting devices instead have been configured by the user to have their light emission windows on top they will emit a wall wash light effect (e.g. to create an atmosphere in a room where the wall is located).

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. The reference to first data, second data, third data, etc. does not indicate any order or relationship between such data. Any reference signs in the claims should not be construed as limiting the scope.

The invention claimed is:

1. A method of controlling a plurality of lighting devices in a user determinable configuration, the method comprising:

receiving positional data comprising the positions of multiple of the plurality of lighting devices in the user determinable configuration, determining, based on the received positional data, a shape of the configuration of the plurality of lighting devices, receiving a set of light scenes, each light scene of the set of light scenes associated with a shape, selecting a light scene from the set of light scenes by matching the determined shape to the shape associated with the light scene, and controlling the plurality of lighting devices based on the selected light scene.

2. The method according to claim 1, wherein determining the shape of the configuration of the plurality of lighting devices is further based on a light pattern shape the plurality of lighting devices produces, when emitting light.

3. The method according to claim 1, wherein the positional data comprises the relative position of one or more of the plurality of lighting devices towards one or more objects.

4. The method according to claim 3, wherein the one or more objects are a further one or more lighting devices of the plurality of lighting devices.

5. The method according to claim 1, wherein the method further comprises:

determining a size of the determined shape of the configuration of the plurality of lighting devices, and wherein controlling the plurality of lighting devices is further based on the determined size.

6. The method according to claim 1, wherein the method further comprises:

determining the number of lighting devices that are comprised in the plurality of lighting devices, and wherein controlling the plurality of lighting devices is further based on the determined number.

7. The method according to claim 1, wherein the method further comprises:

determining the distance between at least one lighting device of the plurality of lighting devices and at least a further one lighting device of the plurality of lighting devices, and wherein controlling the plurality of lighting devices is further based on the determined distance.

8. The method according to claim 1, wherein the method further comprises:

determining an orientation of at least one lighting device of the plurality of lighting devices, and wherein controlling the plurality of lighting devices is further based on the determined orientation.

9. The method according to claim 8, wherein the orientation of the at least one lighting device of the plurality of lighting devices is relative to the environment of the configuration of the plurality of lighting devices.

10. The method according to claim 8, wherein the orientation of the at least one lighting device of the plurality of lighting devices is relative to a further at least one lighting device of the plurality of lighting devices.

11. The method according to claim 1, wherein a further lighting device, not part of the plurality of lighting devices, is controlled based on the selected light scene.

12. A non-transitory computer readable medium comprising computer program code means for controlling a plurality of lighting devices in a user determinable configuration, the computer program code, when run on one or more processors, performing the steps of:

receiving positional data comprising the positions of multiple of the plurality of lighting devices in the user determinable configuration, determining, based on the received positional data, a shape of the configuration of the plurality of lighting devices, receiving a set of light scenes, each light scene of the set of light scenes associated with a shape, selecting a light scene from the set of light scenes by matching the determined shape to the shape associated with the light scene, and controlling the plurality of lighting devices based on the selected light scene.

13. A controller for controlling a plurality of lighting devices in a user determinable configuration, the controller comprising:

a first interface arranged for receiving positional data comprising the positions of multiple of the plurality of lighting devices in the user determinable configuration, a second interface arranged for receiving a set of light scenes, and for receiving an association of each light scene of the set of light scenes to a shape, and a processor arranged for determining a shape of the configuration of the plurality of lighting devices, and selecting a light scene from the set of light scenes by matching the determined shape to the shape associated with the light scene, the processor further arranged for controlling the plurality of lighting devices based on the selected light scene.

14. A lighting device comprising the controller according to claim 13, wherein the controller is embedded in the lighting device.

15. A system comprising a plurality of lighting devices and the controller according to claim 13.

* * * * *